US009983495B2

(12) United States Patent
Ueda et al.

(10) Patent No.: US 9,983,495 B2
(45) Date of Patent: May 29, 2018

(54) ELECTROSTATIC IMAGE DEVELOPING TONER

(71) Applicant: Konica Minolta, Inc., Tokyo (JP)

(72) Inventors: Junya Ueda, Hino (JP); Kenshi Miyajima, Hino (JP); Takaki Kawamura, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/278,647

(22) Filed: Sep. 28, 2016

(65) Prior Publication Data

US 2017/0212440 A1 Jul. 27, 2017

(30) Foreign Application Priority Data

Jan. 27, 2016 (JP) ..... 2016-013006

(51) Int. Cl.
*G03G 9/087* (2006.01)

(52) U.S. Cl.
CPC ..... *G03G 9/08755* (2013.01); *G03G 9/08711* (2013.01); *G03G 9/08797* (2013.01)

(58) Field of Classification Search
CPC ..... G03G 9/08755; G03G 9/08797; G03G 9/08711
See application file for complete search history.

(56) References Cited

U.S. PATENT DOCUMENTS 6,303,257 B1 * 10/2001 Hasegawa ..... G03G 9/08711 430/109.3
2008/0187854 A1 * 8/2008 Yoshida ..... G03G 9/0804 430/109.4
2012/0122026 A1 * 5/2012 Taguchi ..... G03G 9/0806 430/105

FOREIGN PATENT DOCUMENTS

JP 2009122522 A 6/2009
JP 2013254123 A 12/2013
JP 2015148724 A 8/2015

OTHER PUBLICATIONS

Extended European Search Report dated Jun. 19, 2017 from corresponding European Patent Application No. 16191248.0.

* cited by examiner

*Primary Examiner* — Thorl Chea
(74) *Attorney, Agent, or Firm* — Lucas & Mercanti. LLP

(57) ABSTRACT

An electrostatic image developing toner including a toner particle, wherein the toner particle contains a vinyl resin which is a polymer of a vinyl monomer having an acid group, a polyester resin, at least one of aluminum (Al) and magnesium (Mg), and tin (Sn), and when net intensities of Al, Mg and Sn in the toner particle measured by fluorescent X-ray analysis are respectively expressed as $I_{Al}$, $I_{Mg}$ and $I_{Sn}$, a ratio $(I_{Al}+I_{Mg})/I_{Sn}$ is within a range of 0.5 to 2.5.

8 Claims, No Drawings

ELECTROSTATIC IMAGE DEVELOPING TONER

BACKGROUND OF THE INVENTION

1. Field of the Invention

The present invention relates to an electrostatic image developing toner, more specifically, an electrostatic image developing toner having excellent low-temperature fixability and hot-offset resistance and high followability of gloss to paper even in the coexistence of a vinyl resin and a polyester resin.

2. Description of Related Art

In electrophotographic image forming apparatuses, electrostatic image developing toners (hereinafter, also simply referred to as "toners") that can be thermally fixed at a lower temperature are demanded for energy saving in, for example, a high-speed image formation and a low environmental load.

A decrease in fixing temperature of a toner requires a reduction in melting temperature or melt viscosity of the binder resin contained in the toner. A decrease in the glass transition point (Tg) or molecular weight of the binder resin for reducing the melting temperature or melt viscosity of the binder resin, however, decreases the thermal storage stability of the toner.

It has been accordingly proposed to use both a styrene-acrylic resin and a polyester resin, which gives an advantage of easily reducing the softening point while maintaining the high glass transition point (for example, see JP 2013-254123).

Although the coexistence of a vinyl resin, such as a styrene-acrylic resin, and a polyester resin gives low-temperature fixability, the vinyl resin and the polyester resin differ from each other in the melting rate at the time of fixing; hence a difference in gloss between the resins occurs after fixing, failing to provide high gloss to the images. In formation of an image on paper having high glossiness, such as coated paper or art paper, since the gloss of the image is lower than that of the paper, the image gives depressive impression to deteriorate the image quality and texture.

In order to form a high gloss image, it has been proposed to control the contents (contained amounts) of aluminum and tin in a toner to specific amounts (for example, see JP 2009-122522). However, such mere control cannot provide low gloss to images formed on paper having low glossiness, such as rough paper.

In order to reduce the gloss of an image, it has been proposed to use both a styrene-acrylic resin and a polyester resin and further adjust the net intensity of aluminum in the toner within a specific range (for example, see JP 2015-148724).

However, such a proposed Net intensity ratio of aluminum to tin causes a large difference in melting rate between the styrene-acrylic resin and the polyester resin, failing to form high gloss images on high gloss paper.

SUMMARY OF THE INVENTION

The present invention has been made in view of the above-mentioned problems and circumstances, and an object of the present invention is to provide an electrostatic image developing toner having excellent low-temperature fixability and hot-offset resistance and high followability of gloss to paper even in the coexistence of a vinyl resin and a polyester resin.

The present inventors have found, in the process of investigating the causes of the above-mentioned problems for achieving the above-mentioned object, that in the coexistence of a vinyl resin and a polyester resin having different melting rates, control of the ratio of the net intensity of one or both of metal elements Al and Mg contributing to crosslinking of vinyl resin molecules to the net intensity of metal element Sn contributing to crosslinking of polyester resin molecules within a specific range can maintain excellent low-temperature fixability and hot-offset resistance and can achieve high followability of gloss to paper, and has arrived at the present invention.

That is, in order to solve the above problems, according to aspects of the present invention, there are provided following toners.

1. An electrostatic image developing toner including a toner particle, wherein the toner particle contains a vinyl resin which is a polymer of a vinyl monomer having an acid group, a polyester resin, at least one of aluminum (Al) and magnesium (Mg), and tin (Sn), and when net intensities of Al, Mg and Sn in the toner particle measured by fluorescent X-ray analysis are respectively expressed as $I_{Al}$, $I_{Mg}$ and $I_{Sn}$, a ratio $(I_{Al}+I_{Mg})/I_{Sn}$ is within a range of 0.5 to 2.5.
2. The electrostatic image developing toner according to the item 1, wherein the ratio $(I_{Al}+I_{Mg})/I_{Sn}$ is within a range of 0.8 to 2.5.
3. The electrostatic image developing toner according to the item 1, wherein a sum $(I_{Al}+I_{Mg}+I_{Sn})$ of the net intensities of Al, Mg and Sn is 3.5 kcps or more.
4. The electrostatic image developing toner according to the item 1, wherein, in a case where the toner particle contains Al and does not contain Mg, the net intensity $I_{Al}$ of Al is within a range of 2.0 to 6.0 kcps.
5. The electrostatic image developing toner according to the item 1, wherein, in a case where the toner particle contains Mg and does not contain Al, the net intensity $I_{Mg}$ of Mg is within a range of 1.0 to 3.5 kcps.
6. The electrostatic image developing toner according to the item 1, wherein a content of the vinyl resin in the toner particle is within a range of 20 to 60 mass %.
7. The electrostatic image developing toner according to the item 1, wherein a content of the vinyl resin in the toner particle is within a range of 35 to 60 mass %.
8. The electrostatic image developing toner according to the item 1, wherein the vinyl resin is a styrene-acrylic resin.
9. The electrostatic image developing toner according to the item 1, wherein the toner particle contains a crystalline polyester resin as the polyester resin.

DETAILED DESCRIPTION OF THE PREFERRED EMBODIMENT

The electrostatic image developing toner of the present invention contains toner particles. The toner particles contain a vinyl resin being a polymer of a vinyl monomer having an acid group; a polyester resin; at least one of aluminum (Al) and magnesium (Mg); and tin (Sn), and when net intensities of Al, Mg and Sn in the toner particles measured by fluorescent X-ray analysis are respectively expressed as $I_{Al}$, $I_{Mg}$ and $I_{Sn}$, a ratio $(I_{Al}+I_{Mg})/I_{Sn}$ is within a range of 0.5 to 2.5. Such technical characteristics are common to the invention according to each claim.

In an embodiment of the present invention, the ratio $(I_{Al}+I_{Mg})/I_{Sn}$ is within a range of 0.8 to 2.5, from the viewpoint of achieving higher followability of gloss.

Furthermore, the sum $(I_{Al}+I_{Mg}+I_{Sn})$ of net intensities of Al, Mg, and Sn is preferably 3.5 kcps or more, from the viewpoint of enhancing the fracture resistance of the toner and preventing an excess increase in gloss of images.

From the viewpoint of further enhancing the fracture resistance and further preventing an excess increase in gloss of images, toner particles containing Al but not containing Mg preferably have a net intensity $I_{Al}$ of Al within a range of 2.0 to 6.0 kcps, while toner particles containing Mg but not containing Al preferably have a net intensity $I_{Mg}$ of Mg within a range of 1.0 to 3.5 kcps.

The content of the vinyl resin in the toner particles is preferably within a range of 20 to 60 mass %, more preferably within a range of 35 to 60 mass %, from the viewpoint of facilitating a reduction in gloss of images formed on low gloss paper.

The vinyl resin is preferably a styrene-acrylic resin from the viewpoint of enhancing the thermal storage stability of the toner.

The toner particles preferably contain a crystalline polyester resin as a polyester resin from the viewpoint of enhancing the low-temperature fixability of the toner.

The present invention, constituents, and embodiments implementing the present invention will now be described in detail.

It should be noted that, in the present application, the term "to" indicating the numerical range is meant to be inclusive of the lower and upper limits represented by the numerals given before and after the term.

[Electrostatic Image Developing Toner]

The electrostatic image developing toner of the present invention contains toner particles. The toner particles at least contain a vinyl resin being a polymer of a vinyl monomer having an acid group; a polyester resin; at least one of aluminum (Al) and magnesium (Mg); and tin (Sn), and may further contain, for example, a release agent and a coloring agent.

[Vinyl Resin]

In the present invention, the toner particles contain a vinyl resin as one binder resin. The vinyl resin is a polymer of a vinyl monomer having an acid group.

Such a vinyl resin easily causes ionic crosslinking between resin molecules and can easily control the degree of ionic crosslinking by adjusting the content of the acid group in the vinyl resin.

Examples of the vinyl resin include styrene-acrylic resins, styrene resins, and acrylic resins. In particular, styrene-acrylic resins are preferred from the viewpoint of achieving excellent thermal storage stability.

The term "vinyl monomer" refers to a polymerizable monomer having a vinyl group. Examples of the vinyl monomer are shown below. In particular, the use of a multifunctional vinyl monomer can provide a polymer having a crosslinked structure.

(1) Styrenic Monomer

Monomers having styrene structures, such as styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and derivatives thereof.

(2) (Meth)Acrylate Ester Monomer

Monomers having (meth)acryl groups, such as methyl (meth)acrylate, ethyl (meth)acrylate, n-butyl (meth)acrylate, isopropyl (meth)acrylate, isobutyl (meth)acrylate, t-butyl (meth)acrylate, n-octyl (meth)acrylate, 2-ethylhexyl (meth) acrylate, stearyl (meth)acrylate, lauryl (meth)acrylate, phenyl (meth)acrylate, diethylaminoethyl (meth)acrylate, dimethylaminoethyl (meth)acrylate, and derivatives thereof.

(3) Vinyl Esters

Vinyl esters, such as vinyl propionate, vinyl acetate, and vinyl benzoate.

(4) Vinyl Ethers

Vinyl ethers, such as vinyl methyl ether and vinyl ethyl ether.

(5) Vinyl Ketones

Vinyl ketones, such as vinyl methyl ketone, vinyl ethyl ketone, and vinyl hexyl ketone.

(6) N-Vinyl Compounds

N-vinyl compounds, such as N-vinylcarbazole, N-vinylindole, and N-vinylpyrrolidone.

(7) Others

Others, such as vinyl compounds, such as vinylnaphthalene and vinylpyridine; and acrylic acid or methacrylic acid derivatives, such as acrylonitrile, methacrylonitrile, and acrylamide.

(8) Multifunctional Vinyls

Multifunctional vinyls, such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

The term "acid group" refers to an ionically dissociable group, for example, a carboxy, sulfonate, or phosphate group.

Examples of the vinyl monomer having a carboxy group include acrylic acid, methacrylic acid, maleic acid, itaconic acid, cinnamic acid, fumaric acid, maleic acid monoalkyl ester, and itaconic acid monoalkyl ester.

Examples of the vinyl monomer having a sulfonate group include styrenesulfonic acid, allylsulfosuccinic acid, and 2-acrylamido-2-methylpropanesulfonic acid.

Examples of the vinyl monomer having a phosphate group include acid phosphoxy ethyl methacrylate.

The vinyl resin may be synthesized using these vinyl monomers having acid groups alone or in combination or using these vinyl monomers having acid groups in combination with one or more vinyl monomers having no acid group.

The vinyl resin preferably has a glass transition point (Tg) of 20° C. to 70° C. from the viewpoint of achieving compatibility between low-temperature fixability and thermal storage stability.

The glass transition point (Tg) can be measured in accordance with the method (DSC) specified in American Society for Testing and Material Standard (ASTM) D3418-82 with, for example, a differential scanning calorimeter DSC-7 (manufactured by PerkinElmer, Inc.) or thermal analyzer controller TACT/DX (manufactured by PerkinElmer, Inc.).

The content of the vinyl resin in the toner particles is preferably within a range of 20 to 60 mass %, more preferably 35 to 60 mass %, from the viewpoint of providing low gloss images on low gloss paper, such as rough paper.

[Polyester Resin]

In the present invention, the toner particles contain a polyester resin as one binder resin. The polyester resin may be a crystalline polyester resin, an amorphous polyester resin, or a mixture thereof.

[Crystalline Polyester Resin]

The crystalline polyester resin is a known polyester resin showing crystallinity prepared by a polycondensation reaction of a di- or higher valent carboxylic acid (polyvalent carboxylic acid) monomer and a di- or higher valent alcohol (polyhydric alcohol) monomer. The crystallinity is demonstrated by a melting point, i.e., a clear endothermic peak, in the endothermic curve measured by differential scanning calorimetry (DSC). The term "clear endothermic peak" refers to a peak having a half-width of 15° C. or less in an endothermic curve at a heating rate of 10° C./min.

The addition of a crystalline polyester resin to the toner improves the low-temperature fixability.

The crystalline polyester resin may be synthesized by any method and can be formed by polymerization (esterification) of a polyvalent carboxylic acid monomer and a polyhydric alcohol monomer mentioned above in the presence of an esterification catalyst.

The polyvalent carboxylic acid monomer is a compound containing two or more carboxy groups in one molecule.

Examples of the polyvalent carboxylic acid monomer usable in the synthesis of the crystalline polyester resin include saturated aliphatic dicarboxylic acids, such as oxalic acid, malonic acid, succinic acid, adipic acid, sebacic acid, azelaic acid, n-dodecylsuccinic acid, and 1,10-decanedicarboxylic acid (dodecanedioic acid); cycloaliphatic dicarboxylic acids, such as cyclohexanedicarboxylic acid; aromatic dicarboxylic acids, such as phthalic acid, isophthalic acid, and terephthalic acid; tri- or higher valent carboxylic acids, such as trimellitic acid and pyromellitic acid; and anhydrides or C1-3 alkyl esters of these carboxylic acid compounds.

These monomers may be used alone or in combination.

The polyhydric alcohol monomer is a compound containing two or more hydroxy groups in one molecule.

Examples of the polyhydric alcohol monomer usable in the synthesis of the crystalline polyester resin include aliphatic diols, such as 1,2-propanediol, 1,3-propanediol, 1,4-butanediol, 1,5-pentanediol, 1,6-hexanediol, 1,7-heptanediol, 1,8-octanediol, 1,9-nonanediol, neopentyl glycol, and 1,4-butenediol; and tri- or higher valent polyhydric alcohols, such as glycerol, pentaerythritol, trimethylolpropane, and sorbitol.

These monomers may be used alone or in combination.

The esterification catalyst used in the present invention is a tin compound. Examples of the tin compound include, but not limited to, halogenated tin compounds (for example, tin dichloride and tin tetrachloride) and tin organic carboxylates (for example, tin octanoate and tin octylate).

The polymerization may be performed at any temperature, preferably at 150° C. to 250° C., for any period of time, preferably for 0.5 to 10 hours. During the polymerization, the pressure of the reaction system may be reduced as needed.

The crystalline polyester resin preferably has a melting point (Tm) within a range of 50° C. to 85° C. from the viewpoint of achieving compatibility between excellent low-temperature fixability and thermostability.

The melting point (Tm) is the peak temperature of endothermic peak and can be measured by DSC.

Specifically, a sample is sealed in an aluminum pan KIT NO. B0143013, and the pan is set in a sample holder of a thermal analyzer Diamond DSC (manufactured by PerkinElmer, Inc.). The temperature is programmed in the order of heating, cooling, and reheating. The temperature is raised from room temperature (25° C.) in the first heating stage and from 0° C. in the second heating stage to 150° C. at a rate of 10° C./min, and the temperature of 150° C. is maintained for 5 minutes. In the cooling stage, the temperature is decreased from 150° C. to 0° C. at a rate of 10° C./min, and the temperature of 0° C. is maintained for 5 minutes. The peak temperature of endothermic peak in the endothermic curve during the second heating stage is defined as the melting point.

The content of the crystalline polyester resin in the toner particles is preferably within a range of 5 to 30 mass % from the viewpoint of providing excellent low-temperature fixability.

[Amorphous Polyester Resin]

The amorphous polyester resin is a polyester resin showing amorphousness prepared by a polymerization reaction of a polyvalent carboxylic acid monomer and a polyhydric alcohol monomer. The amorphousness indicates that the endothermic curve of a resin measured by DSC shows a glass transition point (Tg) but does not show a melting point demonstrated by a clear endothermic peak, in the heating process. The term "clear endothermic peak" refers to an endothermic peak having a half-width of 15° C. or less in an endothermic curve at a heating rate of 10° C./min.

The amorphous polyester resin can be synthesized, as in the crystalline polyester resin, by polymerization of a polyvalent carboxylic acid monomer and a polyhydric alcohol monomer in the presence of a tin compound as an esterification catalyst.

Examples of the polyvalent carboxylic acid monomer usable in the synthesis of the amorphous polyester resin include phthalic acid, isophthalic acid, terephthalic acid, trimellitic acid, naphthalene-2,6-dicarboxylic acid, malonic acid, mesaconic acid, dimethylisophthalic acid, fumaric acid, dodecenylsuccinic acid, and 1,10-decanedicarboxylic acid. Among these monomers, preferred are dimethylisophthalic acid, terephthalic acid, dodecenylsuccinic acid, and trimellitic acid.

Examples of the polyhydric alcohol monomer usable in the synthesis of the amorphous polyester resin include di- or tri-valent alcohols, such as ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexane dimethanol, dipropylene glycol, polyethylene glycol, polypropylene glycol, ethylene oxide adduct of bisphenol A (BPA-EO), propylene oxide adduct of bisphenol A (BPA-PO), glycerol, sorbitol, 1,4-sorbitan, and trimethylolpropane. Among these monomers, preferred are ethylene oxide adduct of bisphenol A and propylene oxide adduct of bisphenol A.

[Metal Element]

In the present invention, the toner particles contain aluminum (Al) and/or magnesium (Mg) and tin (Sn) as metal elements.

When net intensities of the metal elements Al, Mg and Sn in the toner particles measured by fluorescent X-ray analysis are respectively expressed as $I_{Al}$, $I_{Mg}$ and $I_{Sn}$, a ratio $(I_{Al}+I_{Mg})/I_{Sn}$ is within a range of 0.5 to 2.5.

This range can control the difference in melting rate between the vinyl resin and the polyester resin such that an image formed on high gloss paper can have high gloss and that an image formed on low gloss paper can have low gloss, and thus can achieve high followability of gloss to paper.

The net intensity measured by fluorescent X-ray analysis is the X-ray intensity calculated by subtracting the background intensity from the X-ray intensity at the peak angle indicating the existence of a metal ion.

Since toner particles containing Al but not containing Mg have a net intensity $I_{Mg}$ of zero, the ratio $(I_{Al}+I_{Mg})/I_{Sn}$ represents the ratio $(I_{Al}/I_{Sn})$ of the net intensity of Al to the net intensity of Sn. Similarly, since the toner particles containing Mg but not containing Al have a net intensity $I_{Al}$ of zero, the ratio $(T_{Al}+I_{Mg})/I_{Sn}$ represents the ratio $(I_{Mg}/I_{Sn})$ of the net intensity of Mg to the net intensity of Sn.

Al or Mg is a metal element derived from the flocculant used in the production of the toner. Sn is a metal element derived from the esterification catalyst used in the synthesis of the polyester resin.

The net intensity of Al or Mg represents the degree of crosslinking between vinyl resin molecules. The net intensity of Sn represents the degree of crosslinking between polyester resin molecules. The resins resist melting at the time of fixing as the degree of crosslinking increases.

Originally, the melting rate at the time of fixing of the vinyl resin is smaller than that of the polyester resin. However, an increase in the ratio $((I_{Al}+I_{Mg})/I_{Sn})$ of the net intensities $(I_{Al}+I_{Mg})$ of Al and Mg to the net intensity $I_{Sn}$ of Sn increases the degree of crosslinking of the vinyl resin, relative to the degree of crosslinking of the polyester resin, precluding the melting of the vinyl resin. Consequently, the difference in melting rate between the vinyl resin and the polyester resin is increased. A significantly large difference in melting rate readily causes irregularities on images and reduces the gloss of images formed on paper having less irregularities and high gloss, such as coated paper. In addition, a difficulty in melting of the vinyl resin reduces the low-temperature fixability of the toner.

In contrast, as the ratio $((I_{Al}+I_{Mg})/I_{Sn})$ of the net intensities $(I_{Al}+I_{Mg})$ of Al and Mg to the net intensity $I_{Sn}$ of Sn decreases, the degree of crosslinking of the vinyl resin decreases, relative to the degree of crosslinking of the polyester resin, resulting in ease of melting of the vinyl resin. Consequently, the difference in melting rate between the vinyl resin and the polyester resin is decreased. A significantly small difference in melting rate between these resins increases the gloss of images formed on paper having many irregularities and low gloss, such as rough paper. In addition, ease in melting of the vinyl resin reduces the hot-offset resistance.

In the present invention, it is inferred that the adjustment of the ratio $((I_{Al}+I_{Mg})/I_{Sn})$ of the net intensities within a range of 0.5 to 2.5 controls the melting behaviors of the vinyl resin and the polyester resin, i.e., the difference in melting rate between these resins, such that an image formed on high gloss paper can have high gloss and that an image formed on low gloss paper can have low gloss.

It is also inferred that the adjustment of the degree of crosslinking of the vinyl resin based on the ratio of the net intensities can adjust the melting behaviors of the vinyl resin so as not to inhibit the excellent low-temperature fixability and hot-offset resistance of the toner.

In summary, it is inferred that a toner having excellent low-temperature fixability and hot-offset resistance and high followability of gloss to paper is provided even in the coexistence of a vinyl resin and a polyester resin.

The ratio $(I_{Al}+I_{Mg})/I_{Sn}$ is preferably within a range of 0.8 to 2.5 from the viewpoint of achieving higher followability of gloss.

The sum $(I_{Al}+I_{Mg}+I_{Sn})$ of net intensities of Al, Mg, and Sn is preferably 3.5 kcps or more.

A sum of 3.5 kcps or more can sufficiently crosslink the vinyl resin and the polyester resin to provide excellent fracture resistance to the toner and prevent an excess increase in gloss of images regardless of the glossiness of paper.

The sum $(I_{Al}+I_{Mg}+I_{Sn})$ of net intensities of Al, Mg, and Sn is preferably 10 kcps or less from the viewpoint of preventing leakage caused by the metal element relating to crosslinking under a high-temperature high-humidity environment and preventing the occurrence of fog due to a decrease in the chargeability.

Toner particles containing Al but not containing Mg preferably have a net intensity $I_{Al}$ of Al within a range of 2.0 to 6.0 kcps from the viewpoint of improving the fracture resistance of the toner by crosslinking of the vinyl resin.

From the same viewpoint, toner particles containing Mg but not containing Al preferably have a net intensity $I_{Mg}$ of Mg within a range of 1.0 to 3.5 kcps.

The net intensities of the metal elements Al, Mg, and Sn in the toner particles can be measured with a wavelength-dispersive fluorescent X-ray analyzer XRF-1700 (manufactured by Shimadzu Corporation). Specifically, a sample (3 g) is pressed into a pellet, and the pellet is placed in the fluorescent X-ray analyzer. The analytical conditions are a tube voltage of 40 kV, a tube current of 90 mA, a scanning rate of 8 deg/min, and a step angle of 0.1 deg. The measurement employs the Kα peak angle of a metal element to be measured, which is determined using the 28 table.

The net ratios of Al, Mg, and Sn can be adjusted by the contents of the flocculant used in the production of the toner and the esterification catalyst used in the synthesis of the polyester resin.

[Release Agent]

The release agent may be any known wax. Examples of the usable release agent include polyolefin waxes, such as polyethylene wax and polypropylene wax; branched chain hydrocarbon waxes, such as microcrystalline wax; long chain hydrocarbon waxes, such as paraffin wax and sasol wax; dialkyl ketone waxes, such as distearyl ketone; carnauba waxes; montan waxes; ester waxes, such as behenyl behenate, trimethylolpropane tribehenate, pentaerythritol tetrabehenate, pentaerythritol diacetate dibehenate, glycerol tribehenate, 1,18-octadecanediol distearate, tristearyl trimellitate, and distearyl maleate; and amide waxes, such as ethylenediamine behenylamide and tristearylamide trimellitate.

The content of the release agent can be usually within a range of 1 to 30 parts by mass, preferably 5 to 20 parts by mass, based on 100 parts by mass of the binder resin. The release agent in such an amount can provide sufficient fixing releasability.

The content of the release agent in the toner particles is preferably within a range of 3 to 15 mass %.

[Coloring Agent]

The coloring agent may be a generally known dye or pigment.

As the coloring agent for preparing a black toner, a known agent, for example, carbon black, such as furnace black or channel black; a magnetic material, such as magnetite or ferrite; a dye; or an inorganic pigment containing non-magnetic iron oxide, can be appropriately used.

The coloring agent usable for preparing a color toner may be any known agent, such as a dye or an organic pigment. Examples of the organic pigment include C.I. Pigment Reds 5, 48:1, 53:1, 57:1, 81:4, 122, 139, 144, 149, 166, 177, 178, 222, 238, and 269; C.I. Pigment Yellows 14, 17, 74, 93, 94, 138, 155, 180, and 185; C.I. Pigment Oranges 31 and 43; and C.I. Pigment Blues 15:3, 60, and 76. Examples of the dye include C.I. Solvent Reds 1, 49, 52, 58, 68, 11, and 122; C.I. Solvent Yellows 19, 44, 77, 79, 81, 82, 93, 98, 103, 104, 112, and 162; and C.I. Solvent Blues 25, 36, 69, 70, 93, and 95.

The coloring agents may be used alone or in combination for preparing a color toner.

The content of the coloring agent is preferably within a range of 1 to 10 parts by mass, more preferably 2 to 8 parts by mass, based on 100 parts by mass of the binder resin.

The toner particles can contain, for example, a charge controlling agent or an external additive as needed.

[Charge Controlling Agent] The charge controlling agent may be a known compound, such as a nigrosine dye, a metal salt of naphthenic acid or higher fatty acid, an alkoxylated amine, a quaternary ammonium salt, an azo-metal complex, or a salicylic acid metal salt. The toner containing a charge controlling agent can have excellent charging characteristics.

The content of the charge controlling agent can be usually 0.1 to 5.0 parts by mass based on 100 parts by mass of the binder resin.

[External Additive]

The toner particles can also be directly used as a toner, or may be treated with an external additive, such as a fluidizer or a cleaning aid, for improving the fluidity, chargeability, and cleaning and other characteristics.

Examples of the external additive include inorganic oxide microparticles, such as silica microparticles, alumina microparticles, and titanium oxide microparticles; inorganic stearic acid compound microparticles, such as aluminum stearate microparticles and zinc stearate microparticles; and inorganic titanic acid compound microparticles, such as strontium titanate and zinc titanate. These additives can be used alone or in combination.

These inorganic particles are preferably gloss-processed with, for example, a silane coupling agent, a titanium coupling agent, higher fatty acid, or silicone oil, from the viewpoint of improving thermal storage stability and environmental stability.

The amount of the external additive (in the case of using a plurality of external additives, the total amount) is preferably within a range of 0.05 to 5 parts by mass, more preferably 0.1 to 3 parts by mass, based on 100 parts by mass of the toner.

[Core-Shell Structure]

The toner particles can also be directly used as a toner, or may be formed into toner particles having a multilayer structure such as a core-shell structure composed of a core of the toner particle and a shell layer covering the surface of the particle. The shell layer does not necessarily cover the entire surface of the core particle, and the core particle may be partially exposed. The cross section of the core-shell structure can be observed with known means, for example, a transmission electron microscope (TEM) or a scanning probe microscope (SPM).

In the core-shell structure, the core particle and the shell layer may have different characteristics in, for example, glass transition point, melting point, and hardness to give toner particles meeting the purpose. For example, a shell layer can be formed by aggregation and fusion of a resin having relatively high glass transition point (Tg) on the surface of a core particle containing a binder resin, a coloring agent, a release agent, and other components and having a relatively low glass transition point (Tg). The shell layer preferably contains an amorphous resin.

[Diameter of Toner Particle]

The toner particles preferably have a volume median diameter ($d_{50}$) within a range of 3 to 10 μm, more preferably 5 to 8 μm.

Such a range allows faithful reproduction of a significantly fine dot image, a 1200 dpi level.

The average particle diameter of the toner particles can be controlled by, for example, the concentration of the flocculant and the amount of the organic solvent used in the production, the fusion time, and the composition of the binder resin.

The volume median diameter ($d_{50}$) of toner particles can be measured with an analyzer, Multisizer 3, (manufactured by Beckman Coulter Inc.) connected to a computer system loaded with data processing software, Software V 3.51.

Specifically, a sample (toner) is added to and wetted with a surfactant solution (for example, a surfactant solution, prepared by diluting a neutral detergent containing a surfactant component ten-fold with pure water, for dispersing the toner particles), followed by ultrasonic dispersion to prepare a toner particle dispersion. This toner particle dispersion is poured with a pipette into a beaker containing ISOTON II (manufactured by Beckman Coulter Inc.) placed in a sample stand until the concentration displayed by the analyzer reaches 8%. This concentration allows reproducible measurement. In the measurement, the number of particles to be measured is 25000, the aperture diameter is 100 μm, the measured range of 2 to 60 μm is divided into 256 fractions, and the frequency in each fraction is calculated. The particle diameter of 50% of the volume-integrated fraction from the larger side is defined as a volume median diameter ($d_{50}$).

[Average Circularity of Toner Particles]

The toner particles preferably have an average circularity within a range of 0.930 to 1.000, more preferably 0.950 to 0.995, from the viewpoint of stabilizing the charging characteristics and enhancing the low-temperature fixability.

An average circularity within this range prevents each toner particle from fracturing. As a result, the frictional charging member is prevented from being contaminated to stabilize the chargeability of the toner and to increase the quality of the resulting image.

The average circularity of toner particles can be measured with FPIA-2100 (manufactured by Sysmex Corporation).

Specifically, a sample (toner) is wetted with an aqueous solution containing a surfactant and is then subjected to ultrasonic dispersion for 1 min. Subsequently, photographing with FPIA-2100 (manufactured by Sysmex Corporation) is performed under analytical conditions: a high power field (HPF, high magnification imaging) mode at an appropriate density of the HPF detection number of 3000 to 10000. Within this range of the HPF detection number, the measurement is reproducible. The circularity of each toner particle is calculated by the following expression (I) based on the photographed image of the particles, and the average circularity is determined by summing the degrees of circularity of toner particles and dividing the sum by the number of the toner particles.

Circularity=(perimeter of a circle having the same projected area as that of a particle image)/(perimeter of a projected image of the particle) Expression (I):

[Developer]

The electrostatic image developing toner of the present invention can also be used as a magnetic or nonmagnetic one-component developer or may be mixed with a carrier and be used as a two-component developer. In the use of the toner as a two-component developer, the carrier can be magnetic particles of a known material, for example, a metal, such as iron, ferrite, or magnetite; or an alloy of such a metal with another metal, such as aluminum or lead. Particularly preferred are ferrite particles.

The carrier may be a coated carrier composed of magnetic particles having surfaces coated with a coating agent, such as a resin or may be a dispersed carrier composed of magnetic material fine particles dispersed in a binder resin.

The carrier preferably has a volume median diameter ($d_{50}$) within a range of 20 to 100 μm, more preferably 25 to 80 μm.

The volume median diameter ($d_{50}$) of the carrier can be measured with, for example, a laser diffraction particle size distribution analyzer (HELOS) (manufactured by SYMPATEC GmbH) equipped with a wet-type disperser.

[Method of Producing Electrostatic Image Developing Toner]

The electrostatic image developing toner of the present invention can be produced by, for example, suspension polymerization, emulsion aggregation, or any other known process. In particular, emulsion aggregation is preferred. Emulsion aggregation, which can readily produce toner particles with a small diameter, is preferred from the viewpoint of manufacturing cost and manufacturing stability.

In the production of toner particles by emulsion aggregation, aqueous dispersions of vinyl resin particles, polyester resin particles, and coloring agent particles are mixed to aggregate the vinyl resin, polyester resin, and coloring agent particles to form toner particles.

Herein, the aqueous dispersion is composed of particles dispersed in an aqueous medium. The aqueous medium is mainly composed of water occupying 50 mass % or more of the aqueous medium.

The components other than water in the aqueous medium are organic solvents soluble in water. Examples of the components include methanol, ethanol, 2-propanol, butanol, acetone, methyl ethyl ketone, and tetrahydrofuran. In particular, preferred are alcohol organic solvents that do not dissolve resins, such as methanol, ethanol, 2-propanol, and butanol.

An example of the production steps by emulsion aggregation of a toner will now be described.

(Step (1))

Step (1) prepares an aqueous dispersion of vinyl resin particles.

An aqueous dispersion of vinyl resin particles can be prepared by miniemulsion polymerization. For example, a vinyl monomer and a water-soluble radical polymerization initiator are added to an aqueous medium containing a surfactant as described above, and the mixture is formed into droplets by means of mechanical energy. The radicals from the radical polymerization initiator accelerates the polymerization inside the droplets. The droplets may contain an oil-soluble polymerization initiator.

The vinyl resin particles may have a multilayer structure of two or more layers having different compositions. A dispersion of vinyl resin particles having a multilayer structure can be prepared by multi-stage polymerization. For example, a dispersion of a vinyl resin particles having a two-layer structure can be prepared by polymerizing (first-stage polymerization) a vinyl monomer to prepare a dispersion of vinyl resin particles and further adding a polymerization initiator and a vinyl monomer to the dispersion to perform polymerization (second-stage polymerization).

The aqueous medium is used in an amount of preferably within a range of 50 to 2000 parts by mass, more preferably 100 to 1000 parts by mass, based on 100 parts by mass of the oil-phase solution described below.

The aqueous medium may contain, for example, a surfactant for improving the dispersion stability of oil droplets.

(Surfactant)

The surfactant may be a known surfactant, for example, a cationic surfactant, such as dodecyl ammonium bromide and dodecyl trimethylammonium bromide; an anionic surfactant, such as dodecyl polyoxyethylene ether, hexadecyl polyoxyethylene ether, nonylphenyl polyoxyethylene ether, lauryl polyoxyethylene ether, and sorbitan monooleate polyoxyethylene ether; or a nonionic surfactant, such as sodium stearate, sodium laurate, sodium lauryl sulfate, sodium dodecyl benzenesulfonate, and sodium dodecyl sulfate.

(Polymerization Initiator)

Any known polymerization initiator can be used.

Persulfates (e.g., potassium persulfate and ammonium persulfate) can be preferably used, and, for example, azo compounds, such as 4,4'-azobis(4-cyanovaleric acid) and salts thereof; azo compounds, such as 2,2'-azobis(2-amidinopropane) salts; peroxide compounds; and azobisisobutyronitrile may be used.

(Chain-Transfer Agent)

The aqueous medium can further contain a general chain-transfer agent for adjusting the molecular weight of the vinyl resin. Any chain-transfer agent can be used, and examples of the agent include 2-chloroethanol; mercaptans, such as octyl mercaptan, dodecyl mercaptan, t-dodecyl mercaptan, n-octyl-3-mercaptopropionate; and styrene dimers.

In the production of toner particles containing additives such as the release agent and the charge controlling agent, these additives can be introduced into the toner particles by dissolving or dispersing the additives in a solution of a vinyl monomer in advance.

It is preferred to disperse the additives together with vinyl resin particles in advance. Alternatively, the additives may be introduced into toner particles by preparing a dispersion of particles of the additives separately from the vinyl resin, mixing the dispersions with other dispersions of polyester resin and other particles, and aggregating the additive particles together with the polyester resin and other particles.

The vinyl resin particles in a dispersion preferably have a volume median diameter ($d_{50}$) within a range of 100 to 400 nm.

The volume median diameter ($d_{50}$) of the vinyl resin particles can be measured with Microtrac UPA-150 (manufactured by Nikkiso Co., Ltd.).

(Step (2))

Step (2) prepares an aqueous dispersion of polyester resin particles.

Specifically, a polyester resin is synthesized and is dissolved or dispersed in an organic solvent to prepare an oil-phase solution. This oil-phase solution is subjected to phase inversion emulsification to disperse the polyester resin particles in an aqueous medium. The diameter of the oil droplets is controlled to a desired diameter, and the organic solvent is then removed to give an aqueous dispersion of the polyester resin.

The polyester resin can be synthesized as described above by polymerization (esterification) of a polyvalent carboxylic acid monomer and a polyhydric alcohol monomer in the presence of a tin compound as an esterification catalyst.

The organic solvent used in the oil-phase solution preferably has a low boiling point and a low solubility to water from the viewpoint of readily removing the organic solvent after the formation of oil droplets. Examples of such organic solvents include methyl acetate, ethyl acetate, methyl ethyl ketone, methyl isobutyl ketone, toluene, and xylene. These solvents may be used alone or in combination.

The amount of the organic solvent is usually within a range of 1 to 300 parts by mass based on 100 parts by mass of the crystalline polyester resin.

The oil-phase solution can be emulsified and dispersed by means of mechanical energy.

The amount of the aqueous medium is preferably within a range of 50 to 2000 parts by mass, more preferably 100 to 1000 parts by mass, based on 100 parts by mass of the oil-phase solution.

The aqueous medium may contain, for example, a surfactant for improving the dispersion stability of oil droplets.

The polyester resin particles preferably have a volume median diameter ($d_{50}$) within a range of 100 to 400 nm.

The volume median diameter ($d_{50}$) of the polyester resin particles can be measured with Microtrac UPA-150 (manufactured by Nikkiso Co., Ltd.).

(Step (3))

Step (3) disperses a microparticulate coloring agent in an aqueous medium to prepare an aqueous dispersion of the coloring agent particles.

The aqueous dispersion of coloring agent particles can be prepared by dispersing the coloring agent in an aqueous medium containing a surfactant in an amount higher than the critical micelle concentration (CMC).

The coloring agent can be dispersed by means of mechanical energy with any disperser, preferably, for example, an ultrasonic disperser; a pressure disperser, such as a mechanical homogenizer, Manton-Gaulin homogenizer, and pressure homogenizer; and a medium disperser, such as a sand grinder, Getzman mill, and diamond fine mill.

The coloring agent particles in an aqueous dispersion preferably have a volume median diameter ($d_{50}$) within a range of 10 to 300 nm, more preferably 100 to 200 nm, and furthermore preferably 100 to 150 nm.

The volume median diameter ($d_{50}$) of coloring agent particles can be measured with an electrophoretic light scattering photometer ELS-800 (manufactured by Otsuka Electronics Co., Ltd.).

(Step (4))

Step (4) aggregates vinyl resin particles, polyester resin particles, coloring agent particles, and particles of other toner components in the presence of a flocculant to form toner particles.

Specifically, a flocculant in an amount higher than the critical aggregation concentration is added to a system prepared by mixing an aqueous medium and dispersions of the respective particles, and the mixture is heated to a temperature not lower than the glass transition point (Tg) of the vinyl resin to cause aggregation.

(Flocculant)

The flocculant used is at least one of aluminum (Al) and magnesium (Mg) metal salts, such as aluminum chloride, magnesium chloride, and magnesium sulfate.

The amount of the flocculant is adjusted so as to give the ratio $(I_{Al}+I_{Mg})/I_{Sn}$ within a range of 0.5 to 2.5 depending on the amount of the tin compound used as the esterification catalyst.

(Step (5))

The toner particles formed in Step (4) are aged in Step (5) into a desired shape. Step (5) can be carried out as needed.

Specifically, the dispersion of the toner particles prepared in Step (4) is heated and stirred such that the toner particles have desired circularity by adjusting, for example, the heating temperature, the stirring rate, and the heating time.

(Step (4B))

Step (4B) forms a shell layer coating at least a part of the surface of the toner particle, a core particle, prepared in Step (4) or (5). Step (4B) is performed in the case of forming toner particles having a core-shell structure.

In the case of forming toner particles having a core-shell structure, a resin constituting the shell layer is dispersed in an aqueous medium to prepare a resin particle dispersion for constituting the shell layer. This dispersion is added to the toner particle dispersion prepared in Step (4) or (5) to form shell layers on the surfaces of the toner particles through aggregation and fusion. A dispersion of toner particles having a core-shell structure can be thereby prepared.

After the formation of the shell, heating treatment may be performed for further firmly aggregating and fusing the resin particles of the shell layer to the core particle. The heating treatment may be carried out until toner particles having target circularity are prepared.

(Step (6))

Step (6) cools the toner particle dispersion, preferably under cooling conditions of a cooling rate of 1° C. to 20° C./min. The cooling treatment may be carried out by any process, such as a process of introducing a refrigerant from the outside of the reaction container or a process of directly feeding a cooled water to the reaction system.

(Step (7))

Step (7) collects the toner particles from the cooled toner particle dispersion by solid-liquid separation and removing the adhesive materials, such as the surfactant and flocculant, from the toner cake (wetted toner particles formed in a cake form) prepared by the solid-liquid separation and washing the toner particles.

The solid-liquid separation can be performed by any process, such as centrifugation, vacuum filtration using, for example, a Nutsche, or filtration using, for example, filter press. The washing is preferably performed with water until the electric conductivity of the filtrate reaches 10 ρS/cm.

(Step (8))

Step (8) dries the washed toner cake.

The toner cake can be dried with, for example, a spray dryer, a vacuum freeze dryer, or a vacuum dryer. Preferably, a static shelf dryer, a mobile shelf dryer, a fluidized bed dryer, a tumble dryer, and an agitation dryer can be used.

The moisture of the dried toner particles is preferably 5 mass % or less and more preferably 2 mass % or less.

If the dried toner particles are aggregated with one another by means of weak interparticle attractive force, the aggregate may be disintegrated. The disintegration treatment can be carried out with a mechanical disintegration apparatus, such as a jet mill, a Henschel mixer, a coffee mill, and a food processor.

(Step (9))

Step (9) adds an external additive to the toner particles. Step (9) can be performed as needed.

The addition of an external additive can be performed with a mechanical mixer, such as a Henschel mixer and a coffee mill.

EMBODIMENTS

The present invention will now be described in detail by examples, which should not be construed to limit the present invention. It is noted that "part(s)" and "%" in examples indicate "part(s) by mass" and "mass %", respectively, unless defined otherwise.

[Styrene-Acrylic (StAc) Resin Particle Dispersion]

(First-Stage Polymerization)

An aqueous solution of an anionic surfactant, sodium dodecyl sulfate ($C_{10}H_{21}(OCH_2CH_2)_2SO_3Na$, 4 parts by mass), in deionized water (3040 parts by mass) was fed in a reaction vessel equipped with a stirrer, a temperature sensor, a cooling tube, and a nitrogen-introducing tube. A solution of a polymerization initiator, potassium persulfate (KPS, 10 parts by mass), in deionized water (400 parts by mass) was further added to the reaction vessel, and the solution was heated to 75° C.

Subsequently, a polymerizable monomer solution consisting of styrene (532 parts by mass), n-butylacrylic acid (200 parts by mass), methacrylic acid (68 parts by mass), and n-octyl mercaptan (16.4 parts by mass) was dropwise fed to the reaction vessel over 1 hour, followed by heating at 75° C. for 2 hours with stirring for polymerization (first-stage polymerization). A dispersion of styrene-acrylic resin particles was thereby prepared.

The styrene-acrylic resin particles in the dispersion had a weight average molecular weight (Mw) of 16500.

The weight average molecular weight (Mw) of the resin was calculated from a molecular weight distribution determined by gel permeation chromatography (GPC).

Specifically, a sample was added to tetrahydrofuran (THF) to give a concentration of 1 mg/mL. The mixture was subjected to dispersion treatment with an ultrasonic disperser at room temperature for 5 min and was then applied to a membrane filter having a pore size of 0.2 μm to prepare a sample solution. A carrier solvent, tetrahydrofuran, was supplied at a flow rate of 0.2 mL/min to a GPC apparatus HLC-8120 GPC (manufactured by Tosoh Corporation) and columns consisting of a TSK guard column and three TSK gel Super HZ-m columns sequentially connected (manufactured by Tosoh Corporation), while maintaining the column temperature at 40° C. The sample solution (10 μL) prepared above was injected together with the carrier solvent into the GPC apparatus. The sample was detected with a refractive index detector (RI detector), and the molecular weight distribution of the sample was calculated based on a calibration curve obtained with monodispersed polystyrene standard particles. The calibration curve was formed through measurement of polystyrene standard particles (manufactured by Pressure Chemical Company) having ten different molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

(Second-Stage Polymerization)

A polymerizable monomer solution consisting of styrene (101.1 parts by mass), n-butylacrylic acid (62.2 parts by mass), methacrylic acid (12.3 parts by mass), and n-octyl mercaptan (1.75 parts by mass) was fed in a flask equipped with a stirrer. A release agent, paraffin wax HNP-57 (manufactured by Nippon Seiro Co., Ltd., 93.8 parts by mass), was then added to the flask and was dissolved at an elevated internal temperature of 90° C. A monomer solution was thereby prepared.

Separately, an aqueous solution of the anionic surfactant (3 parts by mass) used in the first-stage polymerization in deionized water (1560 parts by mass) was fed in a container, and the internal temperature was raised to 98° C. The styrene-acrylic resin particle dispersion (32.8 parts by mass in terms of solid content) prepared in the first-stage polymerization was added to the aqueous surfactant solution. A monomer solution containing paraffin wax was further added to the aqueous surfactant solution, followed by mixing and dispersing with a mechanical disperser Clearmix (manufactured by M Technique Co., Ltd.) having a circulation passage for 8 hours. A dispersion containing emulsified particles (oil droplets) having a particle diameter of 340 nm was thereby prepared.

A solution of a polymerization initiator, potassium persulfate (6 parts by mass), in deionized water (200 parts by mass) was added to the dispersion. This system was heated at 98° C. for 12 hours with stirring for polymerization (second-stage polymerization). A styrene-acrylic resin particle dispersion was thereby prepared.

The styrene-acrylic resin particles in the dispersion had a weight average molecular weight (Mw) of 23000.

(Third-Stage Polymerization)

A solution of a polymerization initiator, potassium persulfate (5.45 parts by mass), in deionized water (220 parts by mass) was added to the styrene-acrylic resin particle dispersion prepared in the second-stage polymerization. To this dispersion dropwise added a polymerizable monomer solution consisting of styrene (293.8 parts by mass), n-butylacrylic acid (154.1 parts by mass), and n-octyl mercaptan (7.08 parts by mass) at a temperature of 80° C. over 1 hour. After the completion of the dropwise addition, the system was heated with stirring for 2 hours for polymerization (third-stage polymerization), followed by cooling to 28° C. A dispersion containing styrene-acrylic resin particles was thereby prepared.

The styrene-acrylic resin particles in the dispersion had a weight average molecular weight (Mw) of 26800.

[Crystalline Polyester Particle Dispersion]

A polyvalent carboxylic acid monomer, dodecanedioic acid (355.8 parts by mass), a polyhydric alcohol monomer, 1,9-nonanediol (254.3 parts by mass), and a catalyst, tin octylate (3.21 parts by mass) were placed in a heat-dried three-necked flask. The air in the container was removed by vacuum operation and was purged with nitrogen gas to form an inert atmosphere. The mixture was fluxed at 180° C. for 5 hours with mechanical stirring. The temperature was gradually raised under the inert atmosphere, and the solution was stirred at 200° C. for 3 hours to give a viscous fluid product. The product was further air-cooled while the molecular weight of the product was being measured by GPC, and the reduced pressure was relieved when the weight average molecular weight (Mw) reached 15000 to stop the polycondensation reaction. A crystalline polyester resin was thereby prepared. The resulting crystalline polyester resin had a melting point of 69° C.

Methyl ethyl ketone and isopropyl alcohol were added to a reaction container equipped with an anchor blade for giving stirring power. The crystalline polyester resin was roughly pulverized with a hammer mill and was then gradually added to the container, and the system was stirred for complete dissolution. An oil phase of polyester resin solution was thereby prepared. Several drops of dilute aqueous ammonia solution were added to the stirred oil phase. This oil phase was then dropwise added to deionized water for phase inversion emulsification. The solvent was then eliminated under reduced pressure with an evaporator. Crystalline polyester resin particles were dispersed in the reaction system. Deionized water was added to the dispersion to adjust the solid content to 20 mass %. A dispersion of crystalline polyester resin particles was thereby prepared.

The crystalline polyester resin particles in the dispersion had a volume median diameter of 173 nm measured with Microtrac UPA-150 (manufactured by Nikkiso Co., Ltd.).

[Amorphous Polyester Particle Dispersion]

Polyvalent carboxylic acid monomers, terephthalic acid (139.5 parts by mass) and isophthalic acid (15.5 parts by mass), and polyhydric alcohol monomers, 2,2-bis(4-hydroxyphenyl)propane propylene oxide 2-mol adduct (molecular weight: 460, 290.4 parts by mass) and 2,2-bis(4-hydroxyphenyl)propane ethylene oxide 2-mol adduct (molecular weight: 404, 60.2 parts by mass), were fed in a reaction container equipped with a stirrer, a nitrogen-introducing tube, a temperature sensor, and a fractionator. The temperature of the reaction system was raised to 190° C. over 1 hour. After the reaction system was uniformly stirred, a catalyst, tin octylate (3.21 parts by mass), was fed to the reaction system. The temperature of the reaction system was raised to 240° C. over 6 hours while distilling away the generated water, and the dehydration condensation was continued for 6 hours while maintaining the temperature at 240° C. An amorphous polyester resin was thereby prepared. The resulting amorphous polyester resin had a peak molecular weight (Mp) of 12000 and a weight average molecular weight (Mw) of 15000.

The resulting amorphous polyester resin was subjected to the same operation as that in the preparation of the crystalline polyester resin particle dispersion to prepare an amorphous polyester resin particle dispersion having a solid content of 20 mass %.

The amorphous polyester resin particles in the dispersion had a volume median diameter of 216 nm measured with Microtrac UPA-150 (manufactured by Nikkiso Co., Ltd.).

[Coloring Agent Particle Dispersion]

Sodium dodecyl sulfate (90 parts by mass) was dissolved in deionized water (1600 parts by mass) with stirring. This solution was gradually added to carbon black REGAL 330R (manufactured by Cabot Corporation, 420 parts by mass) with stirring, followed by dispersion treatment with a stirring apparatus CLEARMIX (manufactured by M Technique Co., Ltd.). A coloring agent particle dispersion was thereby prepared.

The coloring agent particles in the dispersion had a particle diameter of 117 nm measured with an electrophoretic light scattering photometer ELS-800 (manufactured by Otsuka Electronics Co., Ltd.).

[Toner (1)]

The styrene-acrylic resin particle dispersion (270 parts by mass in terms of solid content), the amorphous polyester resin particle dispersion (270 parts by mass in terms of solid content), the crystalline polyester resin particle dispersion (60 parts by mass in terms of solid content), and the coloring agent particle dispersion (48 parts by mass in terms of solid content) were fed, as dispersions in the first-stage feeding, to a 5-L stainless steel reactor equipped with a stirrer, a cooling tube, and a temperature sensor. Deionized water (380 parts by mass) was further fed to the reactor, and the pH of the mixture was adjusted to 10 with an aqueous 5 mol/L sodium hydroxide solution with stirring.

An aqueous 10 mass % poly-aluminum chloride solution (5.0 parts by mass) was dropwise added to the reactor over 10 min with stirring, followed by raising the internal temperature to 75° C. The particle diameter was measured with an analyzer, Multisizer 3, (manufactured by Beckman Coulter Inc., aperture diameter: 50 μm), and a solution of sodium chloride (160 parts by mass) in deionized water (640 parts by mass) was added to the reactor after the average diameter reached 5.8 μm. The heating and stirring were continued. After the average circularity measured with a flow particle image analyzer FPIA-2100 (manufactured by Sysmex Corp.) reached 0.960, the internal temperature was decreased to 25° C. at a rate of 20° C./min.

After the cooling, solid-liquid separation was performed with a basket-type centrifugal separator. The resulting wet cake was washed with deionized water of 35° C. in a basket-type centrifugal separator until the electric conductivity of the filtrate decreased to 5 ρS/cm and was then dried in a flash jet dryer (manufactured by Seishin Enterprise Co., Ltd.) until the water content decreased to 0.5 mass %.

Hydrophobic silica (number-average primary particle diameter: 12 nm, 1 part by mass) and hydrophobic titania (number-average primary particle diameter: 20 nm, 0.3 parts by mass) were added to the dried toner (100 parts by mass). The mixture was mixed with a Henschel mixer to produce Toner (1).

[Toner (2)]

Toner (2) was produced as in the production of Toner (1) except that the amount of the aqueous 10 mass % poly-aluminum chloride solution was changed from 5.0 parts by mass to 6.2 parts by mass.

[Toner (3)]

Toner (3) was produced as in the production of Toner (1) except that the amount of the aqueous 10 mass % poly-aluminum chloride solution was changed form 5.0 parts by mass to 2.2 parts by mass.

[Toner (4)]

Toner (4) was produced as in the production of Toner (1) except that an aqueous 50 mass % magnesium chloride solution (10.0 parts by mass) was used instead of the aqueous 10 mass % poly-aluminum chloride solution (5.0 parts by mass).

[Toner (5)]

Toner (5) was produced as in the production of Toner (1) except that an aqueous 50 mass % magnesium chloride solution (12.0 parts by mass) was used instead of the aqueous 10 mass % poly-aluminum chloride solution (5.0 parts by mass).

[Toner (6)]

Toner (6) was produced as in the production of Toner (1) except that an aqueous 50 mass % magnesium chloride solution (4.2 parts by mass) was used instead of the aqueous 10 mass % poly-aluminum chloride solution (5.0 parts by mass).

[Toner (7)]

Toner (7) was produced as in the production of Toner (1) except that the amount of the aqueous 10 mass % poly-aluminum chloride solution was changed from 5.0 parts by mass to 2.5 parts by mass and that an aqueous 50 mass % magnesium chloride solution (5.0 parts by mass) was further added.

[Toner (8)]

Toner (8) was produced as in the production of Toner (1) except that the amount of the styrene-acrylic resin particle dispersion was changed from 270 parts by mass to 360 parts by mass in terms of solid content, that the amount of the amorphous polyester resin particle dispersion was changed from 270 parts by mass to 180 parts by mass in terms of solid content, and that the amount of the aqueous 10 mass % poly-aluminum chloride solution was changed from 5.0 parts by mass to 4.8 parts by mass.

[Toner (9)]

Toner (9) was produced as in the production of Toner (1) except that the amount of the styrene-acrylic resin particle dispersion was changed from 270 parts by mass to 330 parts by mass in terms of solid content and that the amount of the amorphous polyester resin particle dispersion was changed from 270 parts by mass to 210 parts by mass in terms of solid content.

[Toner (10)]

Toner (10) was produced as in the production of Toner (1) except that the amount of the styrene-acrylic resin particle dispersion was changed from 270 parts by mass to 120 parts by mass in terms of solid content, that the amount of the amorphous polyester resin particle dispersion was changed from 270 parts by mass to 420 parts by mass in terms of solid content, and that the amount of the aqueous 10 mass % poly-aluminum chloride solution was changed from 5.0 parts by mass to 2.6 parts by mass.

[Toner (11)]

Toner (11) was produced as in the production of Toner (1) except that the amount of the styrene-acrylic resin particle dispersion was changed from 270 parts by mass to 180 parts by mass in terms of solid content, that the amount of the amorphous polyester resin particle dispersion was changed from 270 parts by mass to 360 parts by mass in terms of solid content, and that the amount of the aqueous 10 mass % poly-aluminum chloride solution was changed from 5.0 parts by mass to 3.6 parts by mass.

[Toner (12)]

Toner (12) was produced as in the production of Toner (1) except that the amount of the styrene-acrylic resin particle dispersion was changed from 270 parts by mass to 120 parts by mass in terms of solid content and that the amount of the amorphous polyester resin particle dispersion was changed from 270 parts by mass to 420 parts by mass in terms of solid content.

[Toner (13)]

Toner (13) was produced as in the production of Toner (1) except that the amount of the styrene-acrylic resin particle dispersion was changed from 270 parts by mass to 360 parts by mass in terms of solid content, that the amount of the amorphous polyester resin particle dispersion was changed from 270 parts by mass to 180 parts by mass in terms of solid content, and that the amount of the aqueous 10 mass % poly-aluminum chloride solution was changed from 5.0 parts by mass to 2.5 parts by mass.

[Toner (14)]

Toner (14) was produced as in the production of Toner (1) except that the amount of the amount of the amorphous polyester resin particle dispersion was changed from 270 parts by mass to 330 parts by mass in terms of solid content and that the amount of the crystalline polyester resin particle dispersion was changed from 60 parts by mass to 0 parts by mass in terms of solid content.

[Toner (15)]

Toner (15) was produced as in the production of Toner (1) except that the amount of the styrene-acrylic resin particle dispersion was changed from 270 parts by mass to 510 parts by mass in terms of solid content, that the amount of the amorphous polyester resin particle dispersion was changed from 270 parts by mass to 30 parts by mass in terms of solid content, and that the amount of the aqueous 10 mass % poly-aluminum chloride solution was changed from 5.0 parts by mass to 1.0 parts by mass.

[Toner (21)]

Toner (21) was produced as in the production of Toner (1) except that the amount of the styrene-acrylic resin particle dispersion was changed from 270 parts by mass to 510 parts by mass in terms of solid content, that the amount of the amorphous polyester resin particle dispersion was changed from 270 parts by mass to 30 parts by mass in terms of solid content, and that the amount of the aqueous 10 mass % poly-aluminum chloride solution was changed from 5.0 parts by mass to 3.5 parts by mass.

[Toner (22)]

Toner (22) was produced as in the production of Toner (1) except that the amount of the aqueous 10 mass % poly-aluminum chloride solution was changed from 5.0 parts by mass to 1.0 parts by mass.

[Toner (23)]

Toner (23) was produced as in the production of Toner (1) except that the amount of the styrene-acrylic resin particle dispersion was changed from 270 parts by mass to 360 parts by mass in terms of solid content and that the amount of the amorphous polyester resin particle dispersion was changed from 270 parts by mass to 180 parts by mass in terms of solid content.

[Toner (24)]

Toner (24) was produced as in the production of Toner (1) except that the amount of the styrene-acrylic resin particle dispersion was changed from 270 parts by mass to 120 parts by mass in terms of solid content, that the amount of the amorphous polyester resin particle dispersion was changed from 270 parts by mass to 420 parts by mass in terms of solid content, and that the amount of the aqueous 10 mass % poly-aluminum chloride solution was changed from 5.0 parts by mass to 3.5 parts by mass.

Table 1 shows the components of Toners (1) to (15) and (21) to (24). In Table 1, StAc represents styrene-acrylic resin; APEs represents amorphous polyester; and CPEs represents crystalline polyester.

TABLE 1

| | FLOCCULANT | | StAc RESIN | | APEs RESIN | | CPEs RESIN | | |
|---|---|---|---|---|---|---|---|---|---|
| TONER NO. | NAME | AMOUNT (PARTS BY MASS) | AMOUNT (PARTS BY MASS) | CONTENT (MASS %) | AMOUNT (PARTS BY MASS) | CONTENT (MASS %) | AMOUNT (PARTS BY MASS) | CONTENT (MASS %) | NOTE |
| 1 | POLY-ALUMINUM CHLORIDE | 5.0 | 270 | 45 | 270 | 45 | 60 | 10 | EXAMPLE |
| 2 | POLY-ALUMINUM CHLORIDE | 6.2 | 270 | 45 | 270 | 45 | 60 | 10 | EXAMPLE |
| 3 | POLY-ALUMINUM CHLORIDE | 2.2 | 270 | 45 | 270 | 45 | 60 | 10 | EXAMPLE |
| 4 | MAGNESIUM CHLORIDE | 10.0 | 270 | 45 | 270 | 45 | 60 | 10 | EXAMPLE |
| 5 | MAGNESIUM CHLORIDE | 12.0 | 270 | 45 | 270 | 45 | 60 | 10 | EXAMPLE |
| 6 | MAGNESIUM CHLORIDE | 4.2 | 270 | 45 | 270 | 45 | 60 | 10 | EXAMPLE |
| 7 | POLY-ALUMINUM CHLORIDE<br>MAGNESIUM CHLORIDE | 2.5<br>5.0 | 270 | 45 | 270 | 45 | 60 | 10 | EXAMPLE |
| 8 | POLY-ALUMINUM CHLORIDE | 4.8 | 360 | 60 | 180 | 30 | 60 | 10 | EXAMPLE |
| 9 | POLY-ALUMINUM CHLORIDE | 5.0 | 330 | 55 | 210 | 35 | 60 | 10 | EXAMPLE |
| 10 | POLY-ALUMINUM CHLORIDE | 2.6 | 120 | 20 | 420 | 70 | 60 | 10 | EXAMPLE |
| 11 | POLY-ALUMINUM CHLORIDE | 3.6 | 180 | 30 | 360 | 60 | 60 | 10 | EXAMPLE |
| 12 | POLY-ALUMINUM CHLORIDE | 5.0 | 120 | 20 | 420 | 70 | 60 | 10 | EXAMPLE |
| 13 | POLY-ALUMINUM CHLORIDE | 2.5 | 360 | 60 | 180 | 30 | 60 | 10 | EXAMPLE |
| 14 | POLY-ALUMINUM CHLORIDE | 5.0 | 270 | 45 | 330 | 55 | 0 | 0 | EXAMPLE |
| 15 | POLY-ALUMINUM CHLORIDE | 1.0 | 510 | 85 | 30 | 5 | 60 | 10 | EXAMPLE |
| 21 | POLY-ALUMINUM CHLORIDE | 3.5 | 510 | 85 | 30 | 5 | 60 | 10 | COMPAR-ATIVE EXAMPLE |
| 22 | POLY-ALUMINUM CHLORIDE | 1.0 | 270 | 45 | 270 | 45 | 60 | 10 | COMPAR-ATIVE EXAMPLE |

TABLE 1-continued

| TONER NO. | FLOCCULANT NAME | FLOCCULANT AMOUNT (PARTS BY MASS) | StAc RESIN AMOUNT (PARTS BY MASS) | StAc RESIN CONTENT (MASS %) | APEs RESIN AMOUNT (PARTS BY MASS) | APEs RESIN CONTENT (MASS %) | CPEs RESIN AMOUNT (PARTS BY MASS) | CPEs RESIN CONTENT (MASS %) | NOTE |
|---|---|---|---|---|---|---|---|---|---|
| 23 | POLY-ALUMINUM CHLORIDE | 5.0 | 360 | 60 | 180 | 30 | 60 | 10 | COMPARATIVE EXAMPLE |
| 24 | POLY-ALUMINUM CHLORIDE | 3.5 | 120 | 20 | 420 | 70 | 60 | 10 | COMPARATIVE EXAMPLE |

[Developer (1) to (15) and (21) to (24)]

Ferrite cores (100 parts by mass) and (cyclohexyl methacrylate)-(methyl methacrylate) (copolymerization ratio: 5/5) copolymer resin particles (5 parts by mass) were fed to a high-speed mixer having agitation blades and were stirred and mixed at 120° C. for 30 min to forma resin coat layer on the surface of the ferrite core by means of mechanical impact. A carrier having a volume median diameter of 40 μm was thereby prepared. The volume median diameter of the carrier was determined with a laser diffraction particle size distribution analyzer (HELOS) (manufactured by SYMPATEC GmbH) equipped with a wet-type disperser. Toners (1) to (15) and (21) to (24) were each added to the carrier such that the toner concentration was 7 mass %. The resulting mixtures were each mixed with a V-shaped micromixer (Tsutsui Scientific Instruments Co., Ltd.) at a rotation rate of 45 rpm for 30 min. Developers (1) to (15) and (21) to (24) were thereby produced.

[Evaluation]

(Net Intensity of Metal Element)

The net intensities $I_{Al}$, $I_{Mg}$, and $I_{Sn}$ of the metal elements Al, Mg, and Sn, respectively, in each of Toners (1) to (15) and (21) to (24) were measured by fluorescent X-ray analysis as follows.

A sample (toner, 3 g) was pressed into a pellet, and the pellet was placed on the fluorescent X-ray analyzer XRF-1700 (manufactured by Shimadzu Corporation). The analytical conditions were a tube voltage of 40 kV, a tube current of 90 mA, a scanning rate of 8 deg/min, and a step angle of 0.1 deg. The measurement employed the Kα peak angle of a metal element to be measured, which was determined using the 28 table. The net intensities $I_{Al}$, $I_{Mg}$ and $I_{Sn}$ of the metal elements Al, Mg, and Sn were each calculated by subtracting the background intensity from the X-ray intensity at the peak angle indicating the existence of metal ion of the metal element Al, Mg, or Sn.

The ratio $(I_{Al}+I_{Mg})/I_{Sn}$ was calculated from the net intensities $I_{Al}$, $I_{Mg}$ and $I_{Sn}$. The sum $(I_{Al}+I_{Mg}+I_{Sn})$ of the net intensities of Al, Mg, and Sn was also calculated.

(Followability of Gloss)

A commercially available color copier bizhub PRESS C6500 (manufactured by Konica Minolta Business Technologies Co., Ltd.) was remodeled to a modified copier such that the fixing temperature, the adhering toner density, and the system speed can be appropriately changed.

The glossiness of size A4 coated paper (POD80 gloss coat (80 g/m$^2$), manufactured by Oji Paper Co., Ltd.) and rough paper (trade name: Hammermill tidal, manufactured by Hammermill Paper Company) was measured. Subsequently, Developers (1) to (15) and (21) to (24) were loaded in turn to the modified copier. A solid image having an adhering toner density of 8.0 g/m$^2$ was formed on each paper, and the glossiness of the solid image was measured. The images were formed under an environment of an ordinary temperature and an ordinary humidity (temperature: 20° C., humidity: 50% RH) and at a fixing temperature of 170° C. The glossiness was measured with a gloss meter "Gloss Meter" (manufactured by Murakami Color Research Laboratory) at an incident angle of 75° using a glass surface having a refractive index of 1.567 as a reference. When the difference between the glossiness of paper before the formation of an image and the glossiness of the image formed on the paper was within ±5°, the followability of gloss was ranked as being acceptable.

(Low-Temperature Fixability and Hot-Offset (HO) Resistance)

Developers (1) to (15) and (21) to (24) were loaded in turn to the modified copier and were subjected to a fixing experiment by fixing a solid image having an adhering toner density of 5 g/m$^2$ on size A4 paper NPI 128 g/m$^2$ (manufactured by Nippon Paper Industries Co., Ltd.) under an environment of an ordinary temperature and an ordinary humidity (temperature: 20° C., humidity: 50% RH). The fixing experiment was repeated by setting the temperature of the lower fixing roller to 100° C. and raising the temperature of the upper fixing belt by 5° C. from 110° C. to 220° C. at a fixing rate of 300 mm/sec. In each fixing experiment, among the fixing temperatures at which no image defect due to offset was visually observed, the lowest fixing temperature was used as an index for evaluating the low-temperature fixability, and the highest fixing temperature was used as an index for evaluating the HO resistance. A toner having a lowest fixing temperature of 165° C. or less and a highest fixing temperature of 190° C. or more was ranked as a toner applicable to practical use.

[Fog]

Developers (1) to (15) and (21) to (24) were loaded in turn to a commercially available color copier bizhub PRESS C6500 (manufactured by Konica Minolta Business Technologies Co., Ltd.), and a text image with a printing ratio of 5% was printed on 500000 sheets under a high temperature and a high humidity (temperature: 30° C., humidity: 85% RH) environment, and a blank image was then printed. The toner density of the paper on which the blank image was printed was measured and was used for evaluating fog. The density was measured with a reflection densitometer RD-918 (manufactured by McBeth Company) at 20 random points on size A4 paper, and the average thereof was calculated. A density (average value) of 0.1 or less was ranked as being acceptable.

[Fracture Resistance]

Developers (1) to (15) and (21) to (24) were fed to the exposure unit of the commercially available copier bizhub PRO C6500 (manufactured by Konica Minolta Business Technologies Co., Ltd.), and the exposure unit was operated with a self-contained driver at a rate of 600 rpm for 3.5 hours. The developer in the exposure unit was sampled, and the toner particle size distribution of the toner was measured with an analyzer, Multisizer 3, (manufactured by Beckman Coulter Inc.). The particle size distribution was compared with that of the toner before being fed into the exposure unit to calculate the rate of increase (mass %) in the number of toner particles of 2.5 μm or less. The fracture resistance was evaluated based on this rate of increase. A higher rate of increase indicates a higher risk of fracture of the toner in the exposure unit. A rate of increase of 3% or less was ranked as a toner applicable to practical use.

Table 2 shows the results of evaluation. In Table 2, HO is the abbreviation of hot-offset.

TABLE 2

| | NET INTENSITY | | | | | FOLLOWABILITY OF GLOSS COATED PAPER | | | ROUGH PAPER |
|---|---|---|---|---|---|---|---|---|---|
| TONER NO. | IAl [kcps] | IMg [kcps] | ISn [kcps] | * RATIO | * SUM [kcps] | GLOSSINESS OF COATED PAPER [°] | GLOSSINESS OF IMAGE [°] | DIFFERENCE [°] | GLOSSINESS OF ROUGH PAPER [°] |
| 1 | 4.8 | 0 | 3.0 | 1.60 | 7.8 | 65 | 66 | 1 | 25 |
| 2 | 6.0 | 0 | 3.0 | 2.00 | 9.0 | 65 | 63 | −2 | 25 |
| 3 | 2.0 | 0 | 3.0 | 0.67 | 5.0 | 65 | 69 | 4 | 25 |
| 4 | 0 | 3.2 | 3.0 | 1.07 | 6.2 | 65 | 63 | −2 | 25 |
| 5 | 0 | 3.5 | 3.0 | 1.17 | 6.5 | 65 | 63 | −2 | 25 |
| 6 | 0 | 1.0 | 1.0 | 1.00 | 2.0 | 65 | 67 | 2 | 25 |
| 7 | 2.4 | 1.6 | 3.0 | 1.33 | 7.0 | 65 | 68 | 3 | 25 |
| 8 | 4.5 | 0 | 1.8 | 2.50 | 6.3 | 65 | 61 | −4 | 25 |
| 9 | 4.8 | 0 | 2.2 | 2.18 | 7.0 | 65 | 62 | −3 | 25 |
| 10 | 2.4 | 0 | 4.8 | 0.50 | 7.2 | 65 | 66 | 1 | 25 |
| 11 | 3.4 | 0 | 5.5 | 0.62 | 8.9 | 65 | 66 | 1 | 25 |
| 12 | 4.8 | 0 | 6.0 | 0.80 | 10.8 | 65 | 66 | 1 | 25 |
| 13 | 2.4 | 0 | 1.1 | 2.18 | 3.5 | 65 | 69 | 4 | 25 |
| 14 | 4.8 | 0 | 3.0 | 1.60 | 7.8 | 65 | 68 | 3 | 25 |
| 15 | 0.9 | 0 | 1.0 | 0.90 | 1.9 | 65 | 69 | 4 | 25 |
| 21 | 3.4 | 0 | 1.0 | 3.40 | 4.4 | 65 | 55 | −10 | 25 |
| 22 | 0.9 | 0 | 3.0 | 0.30 | 3.9 | 65 | 69 | 4 | 25 |
| 23 | 4.8 | 0 | 1.8 | 2.67 | 6.6 | 65 | 57 | −8 | 25 |
| 24 | 3.0 | 0 | 7.3 | 0.41 | 10.3 | 65 | 68 | 3 | 25 |

| | FOLLOWABILITY OF GLOSS ROUGH PAPER | | LOW-TEMPERATURE FIXABILITY | HO RESISTANCE | | FRACTURE RESISTANCE | |
|---|---|---|---|---|---|---|---|
| TONER NO. | GLOSSINESS OF IMAGE [°] | DIFFERENCE [°] | LOWEST FIXING TEMPERATURE [° C.] | HIGHEST FIXING TEMPERATURE [° C.] | FOG DENSITY | RATE OF INCREASE [%] | NOTE |
| 1 | 27 | 2 | 150 | 200 | 0.07 | 1.5 | EXAMPLE |
| 2 | 26 | 1 | 160 | 200 | 0.05 | 0.6 | EXAMPLE |
| 3 | 29 | 4 | 150 | 190 | 0.05 | 2.4 | EXAMPLE |
| 4 | 24 | −1 | 155 | 200 | 0.05 | 2.0 | EXAMPLE |
| 5 | 24 | −1 | 155 | 200 | 0.05 | 2.0 | EXAMPLE |
| 6 | 28 | 3 | 150 | 190 | 0.04 | 6.0 | EXAMPLE |
| 7 | 27 | 2 | 155 | 195 | 0.06 | 1.8 | EXAMPLE |
| 8 | 22 | −3 | 160 | 200 | 0.06 | 2.0 | EXAMPLE |
| 9 | 23 | −2 | 160 | 200 | 0.06 | 1.8 | EXAMPLE |
| 10 | 28 | 3 | 150 | 190 | 0.08 | 0.5 | EXAMPLE |
| 11 | 28 | 3 | 150 | 190 | 0.08 | 0.5 | EXAMPLE |
| 12 | 29 | 4 | 150 | 190 | 0.15 | 0.2 | EXAMPLE |
| 13 | 28 | 3 | 160 | 195 | 0.05 | 2.9 | EXAMPLE |
| 14 | 28 | 3 | 165 | 200 | 0.07 | 1.5 | EXAMPLE |
| 15 | 29 | 4 | 160 | 195 | 0.01 | 6.3 | EXAMPLE |
| 21 | 21 | −4 | 160 | 200 | 0.03 | 2.8 | COMPARATIVE EXAMPLE |
| 22 | 35 | 10 | 150 | 180 | 0.02 | 3.3 | COMPARATIVE EXAMPLE |
| 23 | 22 | −3 | 160 | 200 | 0.05 | 2.1 | COMPARATIVE EXAMPLE |
| 24 | 33 | 8 | 170 | 185 | 0.14 | 0.4 | COMPARATIVE EXAMPLE |

* RATIO: (IAl + IMg)/ISn

* SUM: IAl + IMg + ISn

As shown in Table 2, Toners (1) to (15) having a ratio $(I_{Al}+I_{Mg})/I_{Sn}$ within a range of 0.5 to 2.5 have achieved high followability of gloss to paper in addition to excellent low-temperature fixability and hot-offset resistance.

The entire disclosure of Japanese Patent Application No. 2016-013006 filed on Jan. 27, 2016 including description, claims, drawings, and abstract are incorporated herein by reference in its entirety.

What is claimed is:

1. An electrostatic image developing toner comprising a toner particle, wherein the toner particle comprises a binder resin comprising a vinyl resin which is a polymer of a vinyl monomer having an acid group, and a polyester resin, a content of the vinyl resin in the toner particle is within a range of 20 to 60 mass % by mass binder resin, the toner particle further comprises tin (Sn) and at least one of aluminum (Al) and magnesium (Mg), and a ratio $(I_{Al}+I_{Mg})/I_{Sn}$ is within a range of 0.5 to 2.5, when net intensities of Al, Mg and Sn in the toner particle measured by fluorescent X-ray analysis are respectively expressed as $I_{Al}$, $I_{Mg}$ and $I_{Sn}$.

2. The electrostatic image developing toner according to claim 1, wherein the ratio $(I_{Al}+I_{Mg})/I_{Sn}$ is within a range of 0.8 to 2.5.

3. The electrostatic image developing toner according to claim 1, wherein a sum $(I_{Al}+I_{Mg}+I_{Sn})$ of the net intensities of Al, Mg and Sn is 3.5 kcps or more.

4. The electrostatic image developing toner according to claim 1, wherein, the toner particle contains Al and does not contain Mg, and the net intensity $I_{Al}$ of Al is within a range of 2.0 to 6.0 kcps.

5. The electrostatic image developing toner according to claim 1, wherein, the toner particle contains Mg and does not contain Al, and the net intensity $I_{Mg}$ of Mg is within a range of 1.0 to 3.5 kcps.

6. The electrostatic image developing toner according to claim 1, wherein the content of the vinyl resin in the toner particle is within a range of 35 to 60 mass % by mass binder resin.

7. The electrostatic image developing toner according to claim 1, wherein the vinyl resin is a styrene-acrylic resin.

8. The electrostatic image developing toner according to claim 1, wherein the polyester resin comprises a crystalline polyester resin and an amorphous polyester resin.

* * * * *